US008061109B2

(12) United States Patent
Freudelsperger

(10) Patent No.: US 8,061,109 B2
(45) Date of Patent: Nov. 22, 2011

(54) TABLET FILLING DEVICE

(75) Inventor: Karl Freudelsperger, Hart bei Graz (AT)

(73) Assignee: Knapp Logistik Automation GmbH, Hart Bei Graz (AT)

( * ) Notice: Subject to any disclaimer, the term of this patent is extended or adjusted under 35 U.S.C. 154(b) by 86 days.

(21) Appl. No.: 12/440,185

(22) PCT Filed: Sep. 10, 2007

(86) PCT No.: PCT/AT2007/000428
§ 371 (c)(1),
(2), (4) Date: May 12, 2009

(87) PCT Pub. No.: WO2008/028213
PCT Pub. Date: Mar. 13, 2008

(65) Prior Publication Data

US 2010/0011715 A1 Jan. 21, 2010

(30) Foreign Application Priority Data

Sep. 8, 2006 (AT) ..... A 1504/2006

(51) Int. Cl.
*B65B 57/10* (2006.01)
*B65B 35/18* (2006.01)
*B65B 35/16* (2006.01)
*B65B 5/10* (2006.01)

(52) U.S. Cl. ..... 53/52; 53/498; 53/500; 53/246

(58) Field of Classification Search ..... 53/52, 55, 53/498–500, 154, 539, 237, 244, 246, 281; 221/93, 94, 99, 211; 700/242
See application file for complete search history.

(56) References Cited

U.S. PATENT DOCUMENTS

| | | | | | |
|---|---|---|---|---|---|
| 2,957,290 | A | * | 10/1960 | Andreessen | 53/244 |
| 3,174,789 | A | * | 3/1965 | Scherr | 294/64.1 |
| 3,609,938 | A | * | 10/1971 | Paddock | 53/499 |
| 3,986,638 | A | * | 10/1976 | DeHart | 221/211 |
| 4,251,011 | A | * | 2/1981 | Hamilton et al. | 221/211 |
| 4,301,641 | A | * | 11/1981 | McElwain et al. | 53/244 |
| 4,832,180 | A | * | 5/1989 | Ferrero | 198/468.3 |
| 5,405,048 | A | * | 4/1995 | Rogers et al. | 221/211 |
| 5,442,892 | A | * | 8/1995 | Burns et al. | 53/53 |
| 5,480,062 | A | * | 1/1996 | Rogers et al. | 221/211 |
| 5,571,258 | A | * | 11/1996 | Pearson | 221/211 |
| 5,803,309 | A | | 9/1998 | Yuyama et al. | |
| 6,269,615 | B1 | | 8/2001 | Amborn et al. | |
| 6,607,094 | B2 | * | 8/2003 | MacDonald | 221/211 |
| 2002/0104291 | A1 | * | 8/2002 | Kondou et al. | 53/443 |
| 2003/0160953 | A1 | * | 8/2003 | Gerhard et al. | 356/237.4 |
| 2007/0271638 | A1 | * | 11/2007 | Johnson et al. | 901/3 |
| 2008/0282646 | A1 | * | 11/2008 | Gertitschke et al. | 53/244 |

FOREIGN PATENT DOCUMENTS

| | | | | |
|---|---|---|---|---|
| GB | 2 177 074 | A | | 1/1987 |
| JP | 03279112 | A | * | 12/1991 |
| JP | 03279114 | A | * | 12/1991 |
| WO | 2005/075293 | A1 | | 8/2005 |

* cited by examiner

*Primary Examiner* — Stephen F Gerrity
(74) *Attorney, Agent, or Firm* — Workman Nydegger

(57) ABSTRACT

A device for filling tablets into tablet carriers such as blisters is provided. The device includes , a tablet storage container for intermediately storing a multiplicity of tablets which lie loosely next to one another and above one another. The device also removes a single tablet from the tablet storage container and transfers the received tablet to the tablet carrier. The device thereby removes the tablet from above from the tablet storage container. The device is designed for performing scanning movements above the tablet storage container, where the scanning movements proceed under the control of either predetermined curves or of a sensor for detecting tablets.

10 Claims, 2 Drawing Sheets

TABLET FILLING DEVICE

The invention relates to a device for filling tablets into tablet carriers, e.g., blisters, comprising a tablet storage container for intermediately storing a multiplicity of tablets which lie loosely next to one another and above one another and at least one displaceable load receiving means for removing a single tablet from the tablet storage container and transferring the received tablet to the tablet carrier.

The word "tablet", as used herein, denotes all medicaments present in a solid form, such as, e.g., pills, capsules, lozenges, etc., wherein the component of the "tablet" is completely immaterial for the present invention and comprises, for example, also placebos.

The present invention falls within the technical field of tablet filling devices by means of which compartments of a blister pack or of another tablet carrier can be filled with individual tablets. For filling, the tablets are provided in a loose form.

From document U.S. Pat. No. 5,803,309, a device for isolating tablets in the form of a rotary tablet delivering unit is known. The tablets are thereby removed by a mechanism from a reservoir with loose tablets and delivered at a fixed outlet. The removal of the tablet takes place at the bottom surface of the tablet reservoir. When the tablets in the reservoir slide forward, bridge formations may occur, which hampers a correct isolation. In addition, the isolating mechanism is exposed to the dust resulting from the abrasion of the tablets. A further disadvantage is a lack in the device's ability to be parallelized. That is to say, due to its size, the isolating mechanism cannot simply be arranged in the grid of typical blisters with several compartments. In addition, tablets to be fed into the reservoirs of the rotary tablet delivering unit cannot simply be distributed to all devices in a such way that the latter become empty roughly simultaneously.

A system for automatically filling blisters is known as well, which, however, does not operate with loose tablets. In said known system, the tablets are isolated and packed individually in a first step. For filling the blister compartments, the tablets are removed from said package and distributed to the compartments.

The present invention is thus based on the object of developing further the initially mentioned tablet filling device such that the disadvantages of the prior art are thereby eliminated or at least substantially reduced. In particular, it is an object of the invention to improve the accuracy of the load receiving means during the reception of tablets, thus creating a tablet filling device which operates quickly and reliably.

The invention achieves said object by providing a tablet filling device as disclosed herein. Advantageous embodiments of the invention are described.

The device according to the invention for filling tablets into tablet carriers, e.g., blisters, comprises a tablet storage container for intermediately storing a multiplicity of loose tablets arranged, for example, in the shape of a pile and at least one displaceable load receiving means for removing a single tablet from the tablet storage container and transferring the received tablet to the tablet carrier. An essential feature of the tablet filling device is that the load receiving means removes the tablet from above from the tablet storage container. Furthermore, the load receiving means is designed for performing scanning movements above the tablet storage container, where the scanning movements proceed under the control of either predetermined curves or of a sensor for detecting tablets. Thus, the probability that the load receiving means will be able to receive a tablet with each reception procedure is vastly improved in comparison to prior art devices.

With the tablet filling device according to the invention, the tablet carriers are filled exclusively with tablets that are present in a loose form. In contrast to the prior art, no previous isolating, stacking or sorting of tablets is envisaged. According to the invention, isolating the tablets and filling the tablet carrier takes place rather in one step with only one unit in the form of the load receiving means. Multiplying the load receiving means and hence achieving parallelization is easy and possible in a very small space. In contrast, with known tablet filling devices, isolating the tablets and filling blisters is effected via two separate assembly groups. Since, according to the invention, the tablets are removed from above from the tablet storage container and thus from the surface of the tablet pile, problems caused by bridge formations of tablets in the tablet storage container, as they frequently occur in prior art systems, are ruled out.

In a preferred embodiment of the invention, the tablet storage container has a container bottom tapering downwards so that the container bottom exhibits a geometrically predefined lowest located section in which the probability of the presence of tablets is highest, even if the tablet supply in the tablet storage container is dwindling. For forming the lowest located section of the container bottom, said bottom may exhibit curved and/or inclined straight bottom sections. The inner surface of the container bottom is formed from a smooth material so that there is little tablet abrasion and the tablets slide reliably into the lowest located section.

In a preferred embodiment of the invention, the tablet storage container is designed as a groove or a trough, respectively. Said shape permits multiple parallelization of the tablet filling device, since the lowest located section of the container bottom extends across the entire length of the tablet storage container. Furthermore, it is suitable to design the tablet storage container with a container bottom having a conical or dome-shaped cross-section. For example, the bottom of the tablet storage container may be designed in the manner of an inverted gable roof If the intermediately stored tablet supply in the tablet storage container is dwindling, the remaining tablets concentrate in the lowest located section of the container bottom due to the measures according to the invention. Thus, the load receiving means is always able to firmly grip all tablets for filling down to a very low filling level in the tablet storage container.

In order to ensure that the tablets always slide into the lowest located section of the container bottom of the tablet storage container, the tablet storage container and the container bottom of the tablet storage container, respectively, can be equipped with a vibrator.

Preferably, the load receiving means exhibits a tablet receiving position in the area above the deepest spot of the container bottom of the tablet storage container—and hence at the location of the highest probability of the presence of tablets.

The design of the load receiving means is not restricted any further. In a first preferred embodiment, the load receiving means comprises a suction head communicating with a vacuum generating device. Tablets can thereby be gripped largely without abrasion. The outline of the suction head is essentially adapted to the shape of the tablet to be gripped. In a further preferred embodiment, the load receiving means has grippers, whereby a plurality of differently shaped tablets can be gripped.

In order to ensure that the load receiving means is moved toward the tablet carrier only when it has received precisely one tablet, the load receiving means can comprise a tablet sensor which detects that and delivers the corresponding signals to a control device of the load receiving means.

A further sensor may be provided which detects as to whether a predetermined number of tablets are contained in the tablet carrier in predetermined areas, e.g., in individual compartments of a blister pack. The tablet carrier is conveyed to further processing only if the sensor has detected that the filling with tablets is correct.

Further advantages and features of the invention are evident from the following explanations of exemplary embodiments of the invention with reference to the drawings. In the drawings.

Figure 1:
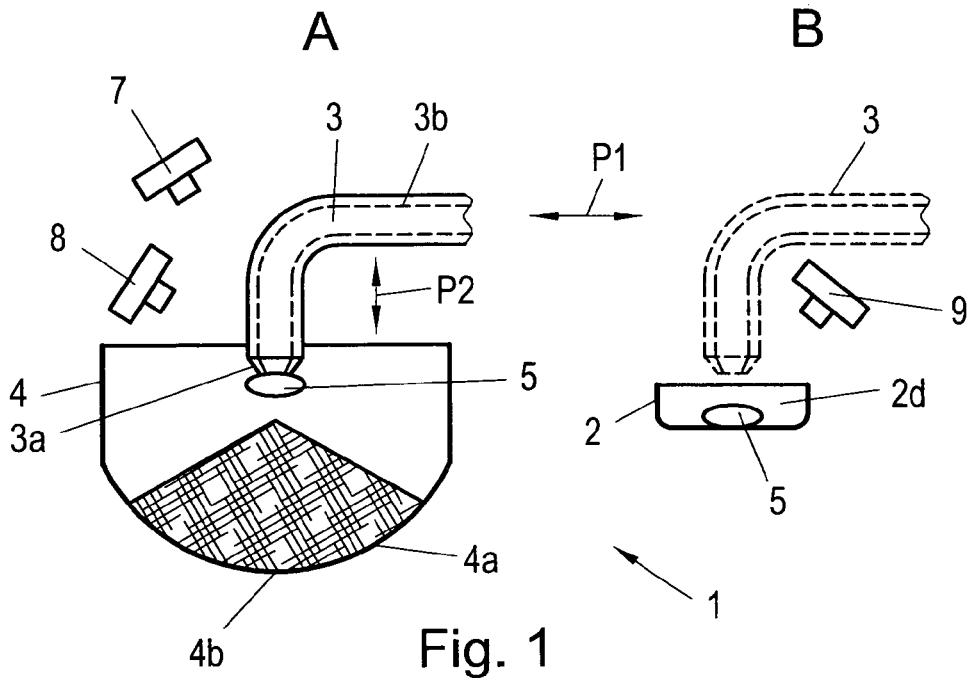
FIG. 1 shows a schematic side view, partially in section, of an exemplary embodiment of a tablet filling device according to the invention.
Figure 2:
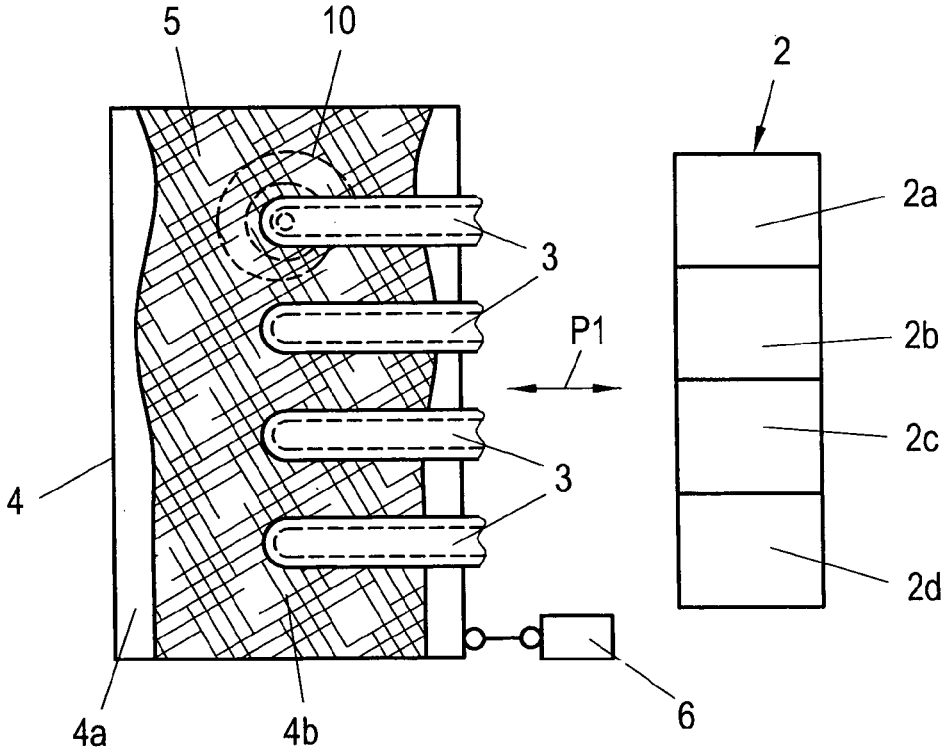
FIG. 2 shows a schematic top view of the exemplary embodiment of the tablet filling device according to the invention.

First with reference to FIG. 1 and FIG. 2, an exemplary embodiment of the tablet filling device 1 according to the invention is now explained in a non-limiting manner.

The device 1 according to the invention for filling tablets into tablet carriers 2, e.g., in the shape of blister packs with a plurality of tablet compartments 2*a*-2*d*, comprises a tablet storage container 4 for intermediately storing a multiplicity of loose tablets 5 located therein. The tablets 5 may, for example, be stacked in a pile. At least one displaceable load receiving means 3 is arranged above the tablet storage container 4, wherein the load receiving means 3 can be reciprocated (arrow P1) between a tablet receiving position A illustrated in solid lines and a tablet delivering position B illustrated in broken lines via a drive (not illustrated). In tablet receiving position A, the load receiving means 3 removes precisely one tablet 5 from the supply of tablets 5 intermediately stored in the tablet storage container 4. The essential feature of the tablet filling device 1 according to the invention is that the load receiving means 3 removes the tablet 5 from above from the tablet storage container 4. Since the height of the pile of tablets 5 in the tablet storage container 4 varies, the load receiving means 3 is displaceable also vertically (see arrow P2). When the load receiving means 3 has received precisely one tablet 5, it is moved into tablet delivering position B where a tablet carrier 2 is already located so that the tablet 5 can be delivered by the load receiving means 3 to a predetermined location in the tablet carrier 2, in the illustration of FIG. 1, for example, in the tablet compartment 2*d*. Each load receiving means 3 receives only one tablet 5 in one operation and delivers it to the tablet carrier 2. However, several load receiving means 3 may be arranged, e.g., in one or two lines, so that a high total operating speed results from this parallelization. In the present exemplary embodiment, four load receiving means 3 are provided. The individual load receiving means 3 can be actuated individually. Since, according to the invention, the tablets 5 are removed from above from the tablet storage container 4 and thus from the surface of the tablet pile, problems caused by bridge formations of tablets 5 in the tablet storage container 4, as they frequently occur in prior art systems, are ruled out.

The container bottom 4*a* of the tablet storage container 4 tapers downwards so that it defines a lowest located section 4*b* in which the probability of the presence of tablets 5 is highest when the tablet supply in the tablet storage container 4 is dwindling. The container bottom 4*a* has a cross-section which is curved in the shape of a dome. The inner surface of the container bottom 4*a* has a smooth surface so that there is little tablet abrasion and the tablets slide reliably into the lowest located section 4*b*. If the intermediately stored tablet supply in the tablet storage container is dwindling, the remaining tablets 5 therefore concentrate in the lowest located section 4*b* of the container bottom 4*a*. Thus, the load receiving means 3 are always able to firmly grip all tablets 5 for filling down to a very low filling level in the tablet storage container 4.

As can be seen in the top view of FIG. 2, the tablet storage container 4 is designed as a groove. Said elongated shape facilitates multiple parallelization of load receiving means 3, since the lowest located section 4*b* of the container bottom 4*a* extends across the entire length of the tablet storage container 4. The groove-shaped tablet storage container 4 can, at the same time, also function as a transport groove for tablets 5.

In order to overcome a static friction possibly existing between the tablets 5 and the surface of the container bottom 4*a*, the container bottom 4*a* of the tablet storage container 4 is connected to a vibrator 6.

In order to increase the probability that the load receiving means 3 will get hold of one tablet 5 each with each reception procedure, the load receiving means 3 can be caused to perform scanning movements above the tablet storage container 4 by a drive means (not illustrated), where the scanning movements either proceed under the control of predetermined curves 10 or are controlled by a sensor 7 for detecting tablets. The sensor 7 may be designed as an optical sensor, e.g., as a video camera.

Figure 3:
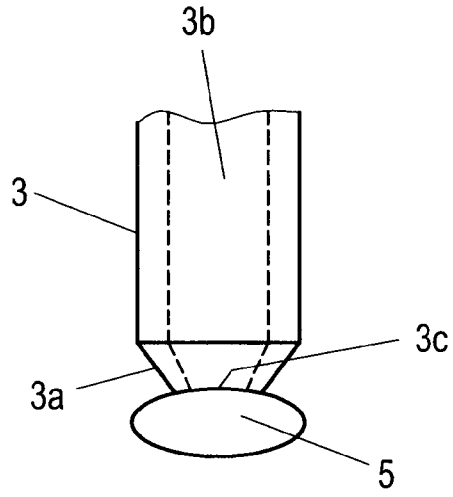
FIG. 3 shows a suction head of a load receiving means according to the invention in longitudinal section.

In the illustrated exemplary embodiment, the load receiving means 3 is designed as a suction means. As is illustrated on an enlarged scale in FIG. 3, it comprises a suction head 3*a* where a vacuum pipe 3*b* communicating with a vacuum source (not illustrated) runs into an intake 3*c*. The outline of the intake 3*c* of the suction head 3*a* is adapted to the shape of the tablet 5 to be gripped so that simultaneous suction of two tablets 5 is largely ruled out.

Figure 4:
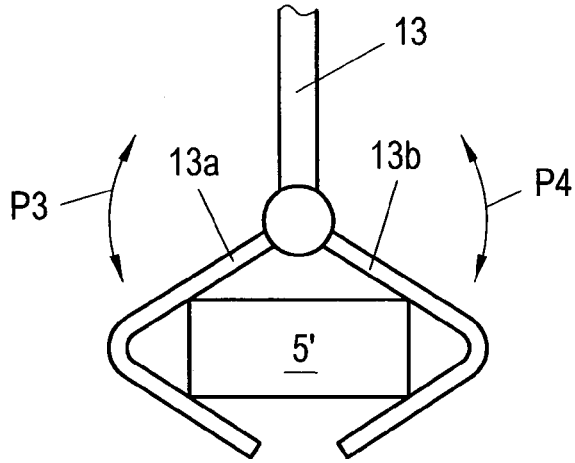
FIG. 4 shows a side view of a load receiving means according to the invention with grippers.

An alternative embodiment of a load receiving means 13 is shown in side view in FIG. 4. Said load receiving means 13 comprises two grippers 13*a*, 13*b* located opposite to each other which are movable toward each other and away from each other (see arrows P3, P4), whereby a plurality of differently shaped tablets can be gripped, e.g., the cylindrical tablet 5' which is illustrated.

In order to ensure that the load receiving means 3, 13 is moved toward the tablet carrier 2 only when it has received precisely one tablet 5, 5', a tablet sensor 8 is provided which detects that and delivers the corresponding signals to a control device (not illustrated) of the load receiving means 3, 13. The sensor 8 is preferably an optical sensor, such as a video camera, and can also be integrated with the sensor 7. Alternatively, the detection of the tablet may also be effected by measuring the weight on the load receiving means or determining the pressure in the vacuum pipe 3*b* or measuring the position of the grippers 13*a*, 13*b* or the momentarily applied grip force.

A further optical sensor 9 detects as to whether a predetermined number of tablets 5 are contained in the tablet carrier 2 in predetermined areas, e.g., in tablet compartments 2*a*-2*d*. The tablet carrier 2 is conveyed to a further processing station only if the sensor 9 has detected that the filling with tablets 5 is correct and complete.

Figure 5:
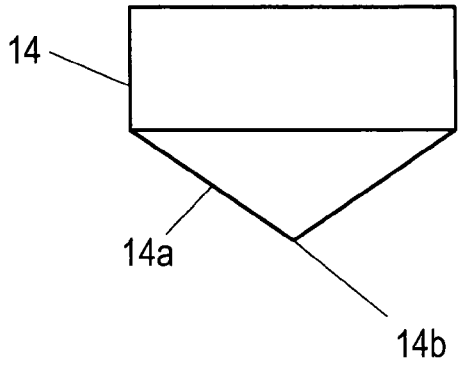
FIG. 5 shows a container bottom of a tablet storage container according to the invention.

FIG. 5 shows a section through an alternative embodiment of a tablet storage container 14 having a conical container bottom 14*a*, whose tip pointed downwards defines the lowest located section 14*b* of the tablet storage container 14. Said form of the container bottom 14*a* is suitable for a single load receiving means.

The invention claimed is:

1. A device for filling tablets into tablet carriers, the device comprising:

a tablet storage container for intermediately storing a multiplicity of tablets which lie loosely next to one another and above one another, wherein the tablet storage container has a container bottom tapering downwards and wherein each of the tablet storage container and the container bottom of the tablet storage container, respectively, is equipped with a vibrator; and at least one displaceable load receiving means for removing a single tablet from the tablet storage container and transferring the received tablet to the tablet carrier, wherein:

the load receiving means removes the tablet from above from the tablet storage container; and the load receiving means is configured for performing scanning movements above the tablet storage container, where the scanning movements proceed under the control of predetermined curves.

2. A tablet filling device according to claim 1, wherein the container bottom exhibits curved and/or inclined straight bottom sections.

3. A tablet filling device according to claim 1, wherein the tablet storage container is designed as a groove.

4. A tablet filling device according to claim 1, wherein the tablet storage container has a container bottom with a conical or dome-shaped cross-section.

5. A tablet filling device according to claim 1, wherein the load receiving means exhibits a tablet receiving position in the area above the deepest spot of the container bottom of the tablet storage container.

6. A tablet filling device according to claim 1, wherein the load receiving means comprises a suction head communicating with a vacuum source.

7. A tablet filling device according to claim 1, wherein the load receiving means has grippers.

8. A tablet filling device according to claim 1, wherein the load receiving means comprises a tablet sensor, with the tablet sensor detecting as to whether the load receiving means has received a tablet.

9. A tablet filling device according to claim 1, further comprising a sensor for detecting whether a predetermined number of tablets are contained in the tablet carrier in predetermined areas.

10. The tablet filling device according to claim 1, wherein the tablet carrier comprises blisters.

* * * * *